US008671499B2

(12) United States Patent
Lim et al.

(10) Patent No.: US 8,671,499 B2
(45) Date of Patent: Mar. 18, 2014

(54) COSMETIC BRUSH SYSTEMS WITH COUPLED CAPS

(75) Inventors: Cindy Sean Yuei Lim, Santa Monica, CA (US); Megan Rene Langdon, Los Angeles, CA (US)

(73) Assignee: HCT Group Holding Limited, Central (HK)

( * ) Notice: Subject to any disclaimer, the term of this patent is extended or adjusted under 35 U.S.C. 154(b) by 0 days.

(21) Appl. No.: 13/292,654

(22) Filed: Nov. 9, 2011

(65) Prior Publication Data

US 2013/0111683 A1 May 9, 2013

(51) Int. Cl.
*A46B 7/02* (2006.01)

(52) U.S. Cl.
USPC ..... 15/184; 15/247; 15/106; 15/143.1; 132/120; 132/313

(58) Field of Classification Search
USPC ..... 15/247, 106, 143.1, 167.1, 184, 168, 15/169; 248/110, 683; 132/120, 313, 317, 132/318
See application file for complete search history.

(56) References Cited

U.S. PATENT DOCUMENTS 4,248,543 A * 2/1981 Carrington et al. ..... 401/183
6,145,151 A * 11/2000 Herron et al. ..... 15/143.1
7,111,354 B2 * 9/2006 Nennig et al. ..... 15/248.1
7,955,014 B2 * 6/2011 Thorpe et al. ..... 401/115

OTHER PUBLICATIONS

The Brush Guard; http://www.thebrushguard.com/ retrieved Oct. 25, 2011, 1 page.

* cited by examiner

*Primary Examiner* — Shay Karls
(74) *Attorney, Agent, or Firm* — Lee & Hayes, PLLC

(57) ABSTRACT

A cosmetic brush system for applying a product to a surface is disclosed. The cosmetic brush system may include a displaceable cap coupled to a handle and a group of bristles fixed to one end of the handle. The displaceable cap may be slideably or peelably coupled to the handle. The handle may include ballast to position a centroid of the cosmetic brush closer to the end of the handle. In embodiments where the displaceable cap is a slideable cap, an end cap may be fixed to the end of the handle and the slideable cap and the end cap may form a uniform elongated cylindrical shape having the same outer diameter. The displaceable cap may also include a ventilation system. By virtue of having a displaceable cap permanently coupled to the handle of the cosmetic brush system, the user cannot misplace the cap and the system is portable and convenient.

17 Claims, 6 Drawing Sheets

COSMETIC BRUSH SYSTEMS WITH COUPLED CAPS

BACKGROUND

Brushes exist for applying cosmetics or medicinal products to the body. For example, brushes having a group of bristles configured to apply loose powder and/or compact powder to a face exist. Good brush hygiene is required because the brushes come in contact with portions of the body. Because good brush hygiene is required, brush guards exist for protecting the group of bristles. For example, after a brush is washed, a brush guard may be disposed over the group of bristles to protect the group of bristles while the brush dries. Further, a brush guard may be disposed over the group of bristles to protect the group of bristles when the brush is stored (e.g., while the brush is in transport). The brush guard keeps the group of bristles in a desired shape and prevents debris from collecting in the group of bristles.

However, to expose the group of bristles of the brush using the existing brush guards, the existing brush guards must be moved along the length of the group of bristles to keep from damaging the group of bristles. Subsequently, the existing brush guards must be removed as separate parts from the brush. As such, the brush guard and/or the brush may become separated and lost from one another. Accordingly, there remains a need in the art for improved brush systems that provide protection for a group of bristles and provides for exposing the group of bristles without having separate parts.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
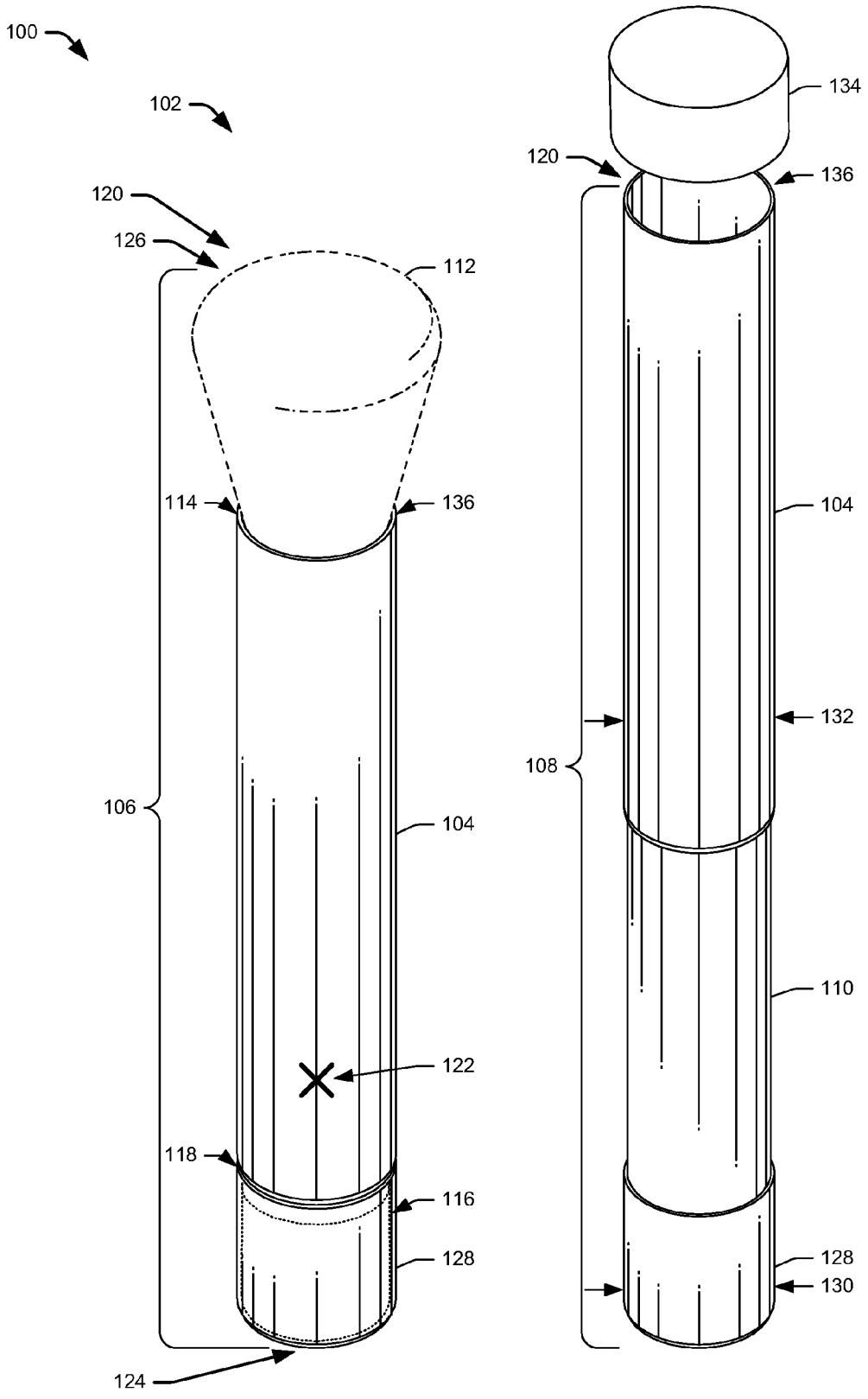
FIG. 1 depicts a perspective view of an illustrative brush system having a slideable cap and a uniform outer diameter in a use position and a stowed position.

This application describes cosmetics brush systems having caps that are displaceably coupled to the handles of the brush systems. The displaceable caps may slide to and/or from a use position and a stowed position or peel to and/or from the use position and the stowed position while remaining coupled to the handle. For example, in the use position the displaceable caps may cover a group of bristles of the cosmetic brush, and in the stowed position the displaceable cap may cover the handle of the cosmetic brush, leaving the group of bristles exposed. The cosmetic brush systems may have uniform elongated cylindrical bodies having equal outside diameters and the slideable caps may include a ventilation system. By virtue of having displaceable caps coupled to a handle of the brushes, devices according to this disclosure are adaptable to conveniently and portably include covers that protect the group of bristles until a time of use. For example, a user may protectively cover a group of bristles by displacing a slideable cap and subsequently store the brush system in a personal effect (e.g., a purse) until a time of use. The brush system retains the displaceable cap on the handle of the brush system while in use so that the displaceable cap will not become lost. While stored in the purse, the displaceable cap will keep the group of bristles clean and intact until the user desires to, for example, apply or retouch a makeup product to portions of the user's body. The displaceable cap may also provide for standing the brush system on an end while the brush system is in use. While the displaceable cap supports the brush system on end, the group of bristles will not come in contact with foreign surfaces.

Generally, a brush system according to this disclosure comprises a handle having a group of bristles fixed in an end of the handle. The brush generally includes a displaceable cap coupled to the handle for selectively sliding and/or peeling over the group of bristles and/or over the handle to alternatively expose the bristles for use or to protect the bristles.

While the brush is described in various embodiments herein as being used to in the cosmetic industry, the brush may be used in the medical industry, painting industry, hobby industry, or the like. Further, while the brush is described in various embodiments herein as having a group of bristles, other types of applicators may also be used, such as, for example, a sponge, flocking, a comb, a combination of any of the foregoing, or the like. In embodiments that employ a group of bristles, various embodiments of the bristles are also contemplated. For example, the group of bristles may comprise a group of hairs that are natural (e.g., animal), synthetic (e.g., plastic or rubber), or the like. Further, the brush may comprise a single unit of bristles over-molded to a handle of the brush and be formed of plastic. For example, the brush may comprise a single unit of shaft-shaped bristles over-molded to the handle of the brush, a single unit of blade-shaped bristles over-molded to the base of the brush, or the like.

In addition, while the brush is described throughout the application as having an elongated cylindrical shape, other types of shapes are also contemplated, such as, for example, elongated oval shape, elongated rectangle shape, elongated triangle shape, etc.

In one example, in which the brush comprises a slideable cap coupled to a handle of the brush and a group of bristles fixed in an end of the handle, the brush may include a ballast fixed in another end of the handle opposite to the group of bristles to position a centroid of the brush closer to a bottom end of the brush than to a top end of the brush. An end cap having an outer diameter that is substantially the same as an outer diameter of the slideable cap coupled to the handle may be fixed to the other end of the handle and encapsulate the ballast. In a stowed position, the slideable cap and the end cap encapsulating the ballast form a uniform elongated cylindrical shape having the same outer diameter, where a user may grip the slideable cap and wield the brush. In a use position, the slideable cap covers the group of bristles, the slideable cap protecting the group of bristles until a time of use. In this embodiment, the brush may include a top cap to removably receive an end of the slideable cap and completely encapsulate the group of bristles covered by the slideable cap when the slideable cap is in the use position. For example, the top cap may removeably couple with an aperture at an end of the slideable cap when in the use position, wherein the group of bristles pass through the aperture when the slideable cap is displaced to the stowed position.

In various embodiments, the slideable cap described herein may include a ventilation system to ventilate the covered group of bristles when the slideable cap is in the use position. In one example, the ventilation system may comprise apertures arranged in the wall of the slideable cap and apertures arranged in the wall of a sleeve rotatably coupled to the slideable cap. When the rotatable sleeve is in an open position, the apertures in the wall of the slideable cap are aligned with the apertures in the wall of the rotatable sleeve to ventilate the covered group of bristles. When the rotatable sleeve is in a closed position, the apertures in the wall of the slideable cap are unaligned with the apertures in the wall of the rotatable sleeve to prevent the covered group of bristles from protruding from the apertures in the wall of the slideable cap when the slideable cap is displaced from the use position to the stowed position.

In another example, the ventilation system may comprise apertures arranged in the wall of the slideable cap and a breathable liner lining an inside of the wall of the sleeve. The breathable liner prevents the covered group of bristles from protruding from the apertures in the wall of the slideable cap when the slideable cap is displaced from the use position to the stowed position but allows air to pass through providing ventilation when the slideable cap is in the use position.

In another example, in which the brush comprises a peelable cap coupled to a handle of the brush, a user may peel the peelable cap to and/or from a use position and a stowed position. In a stowed position, the peelable cap may cover the handle and provide a comfort grip to a user.

Illustrative Brush Systems with Displaceable Caps

FIG. 1 depicts a perspective view 100 an illustrative brush system 102 including a slideable cap 104 in a stowed position 106 and a use position 108. The slideable cap 104 may be coupled to a handle 110 to slide to and/or from the stowed position 106 and the use position 108. The slideable cap 104 may cover a group of bristles 112 fixed in an end 114 of the handle 110 when the slideable cap 104 is in the use position 108.

Ballast 116 may be fixed in another end 118 of the handle 110 opposite to the group of bristles 112. The ballast 116 may be any substance (e.g., metal, sand, liquid, etc.) placed in the end of the handle 110. The assembly comprising the group of bristles 112, the handle 110, the slideable cap 104, and the ballast 116 may form a brush system 120 of the brush system 102. The brush system 120 comprising the group of bristles 112, the handle 110, the slideable cap 104, and the ballast 116 may form an applicator (e.g., a cosmetic brush) useable to apply product to a body. The ballast 116 may position a centroid 122 of the brush system 120 closer to a bottom end 124 of the brush system 120 than to a top end 126 of the brush system 120. With the centroid 122 of the brush system 120 positioned proximate to the bottom end 124 of brush system 120, the brush system 120 may provide a user with increased stability while using the brush system 120 to apply product to a body. For example, with the centroid 122 positioned proximate to the bottom end 124 of the brush system 120, a user may more easily balance the brush system 120 in the user's hand while grasping the handle 110 of the brush system 102. Further, with the centroid 122 positioned proximate to the bottom end 124 of the brush system 120, a user may be imparted with a more aesthetically balanced weight of the brush system 120. For example, with the centroid 122 positioned proximate to the bottom end 124 of the brush system 120, the brush system 120 may impart more weight on the metacarpal (i.e., palm) portion of a user's hand and less weight on the distal phalanges (e.g., finger tips) of the user's hand. Because the brush system 120 may impart more weight on the palm area (e.g., between the thumb and index finger) and less weight on the finger tips, a user may be imparted with a higher level of precision while wielding the brush system 120.

The slideable cap 104 and the handle 110 may be substantially uniform tubes. For example, the cap 104 and the handle 110 may be formed of elongated cylindrical tubes having the same outside diameter along the length of the elongated cylindrical tubes. The uniform tube forming the slideable cap 104 may receive at least a portion of the uniform tube forming the handle 110. An end cap 128 may be fixed to the bottom end 124 of the uniform tube forming the handle 110. The end cap 128 may encapsulate the ballast 116 and receive at least a portion of the uniform tube forming the handle 110. The end cap 128 may have an outer diameter 130 that is substantially the same as an outer diameter 132 of the uniform tube forming the slideable cap 104.

With the slideable cap 104 and the end cap 128 having substantially the same outer diameters 130 and 132, the slideable cap 104 and the end cap 128 encapsulating the ballast 116 form a uniform elongated cylindrical shape when the slideable cap 104 is in the stowed position 106. With the slideable cap 104 in the stowed position 106, a user may grip the slideable cap 104 and wield the brush system 120. For example, with the slideable cap 104 in the stowed position 106, a user may grasp the uniform elongated tubular brush system 120 and apply a product with the exposed group of bristles 112. Further, when the user is done applying product, the slideable cap 104 may be selectively displaced to the use position 108 to cover the group of bristles 112 until another use.

The slideable cap 104 may be coupled to the handle 110 at a time of manufacture of the brush system 102. For example, the slideable cap 104 may be coupled to the handle 110 and then the end cap 128 may be fixed to the handle 110. In this way, the slideable cap 104 is permanently coupled to the handle 110 at a time of manufacture. In this way, the slideable cap 104 is prevented from sliding off the end 118 of the handle 110. Further, the handle 110 may include a stop feature (e.g., detents, tabs, ribs, etc.) arranged in the handle 110 and/or the slideable cap 104 that prevent the slideable cap 104 from sliding off the ends 114 and/or 118.

The brush system 102 may include removeable cap 134. The removeable cap 134 may be removeably coupled with an end 136 of the slideable cap 104. The removeable cap 134 may encapsulate the covered group of bristles 112 when the slideable cap 104 is in the use position 108.

The slideable cap 104, handle 110, end cap 128, and removeable cap 134 may be formed of metal, plastic (e.g., polypropylene (PP), acrylonitrile butadiene styrene (ABS), Polyoxymethylene (POM)), glass, wood, any other suitable material, and/or combination of suitable materials for forming a brush system 102 having a slideable cap 104 that selectively covers a group of bristles 112. For example, the slideable cap 104 may be formed of a die cut aluminum.

While in the illustrated embodiment the group of bristles 112 is illustrated as comprising a dome-shaped group of bristles for application of loose powder and/or pressed powder products such as a blush, the group of bristles 112 may also be used to apply other products, such as foundation, mascara, or other cosmetic products and may take on other shapes, such as having multiple flat fan-shaped group of bristles, a flat rectangular-shaped group of bristles, multiple flat rectangular-shaped groups of bristles, a few individual larger bristles, or the like. Moreover, as discussed above, other, non-brush type applicators may also be used (e.g., sponges, flocking, comb, etc.).

Figure 2:
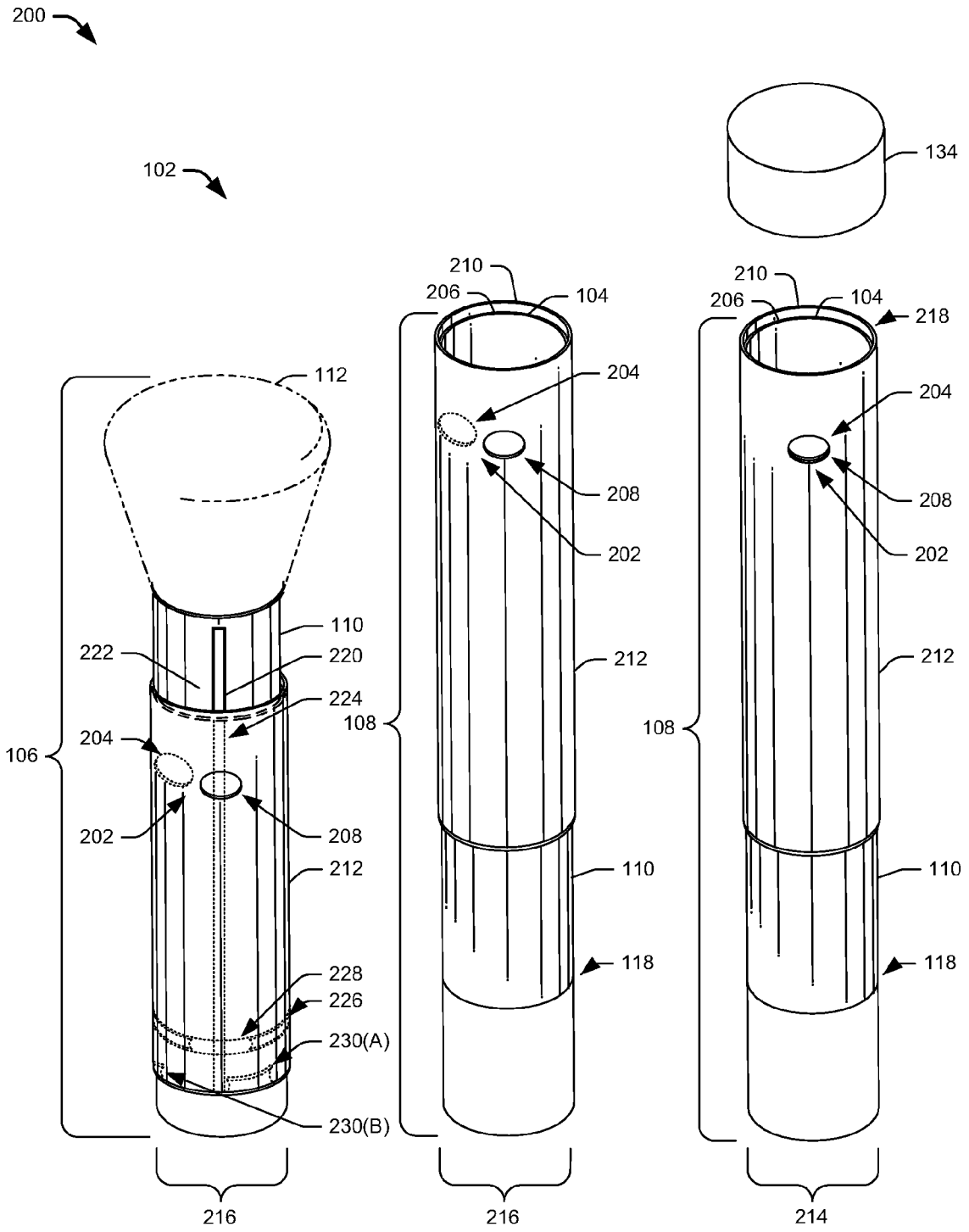
FIG. 2 depicts a perspective view of an illustrative brush system having a slideable cap with a ventilation system.

FIG. 2 depicts a perspective view 200 of an alternative implementation of the illustrative brush system 102 having the slideable cap 104 with a ventilation system 202. The ventilation system 202 may provide for ventilating the covered group of bristles 112 when the slideable cap 104 is in the use position 108. The ventilation system 202 may comprise at least one aperture 204 arranged in a wall 206 of the slideable cap 104 and at least one other aperture 208 arranged in a wall 210 of a sleeve 212. The sleeve 212 may be rotatably coupled to the slideable cap 104.

The rotatable sleeve 212 may rotate to and/or from an open position 214 and a closed position 216. As illustrated, when the rotatable sleeve 212 is in the open position 214, the aperture 204 arranged in the wall 206 of the slideable cap 104 is aligned with the aperture 208 arranged in the wall 210 of the rotatable sleeve 212. With the apertures 204 and 208 aligned they provide for ventilating the covered group of bristles 112. For example, in an effort to practice good brush hygiene, a user may wash the group of bristles 112 and subsequently desire to protect the group of bristles 112 while the group of bristles 112 dry. In this example, a user may slide the slideable cap 104 to the use position 108, rotate the rotatable sleeve 212 to the open position 214, and subsequently let the group of bristles 112 dry inside the slideable cap 104. Because the group bristles 112 are protected by the slideable cap 104 they remain clean and free of debris. Further, because the group of bristles 112 is contained in the slideable cap 104 they keep their desired shape (e.g., dome-shape).

When the rotatable sleeve 212 is in the closed position 216, the aperture 204 arranged in the wall 206 of the slideable cap 104 is unaligned with the aperture 208 arranged in the wall 210 of the rotatable sleeve 212. With the apertures 204 and 208 are unaligned they provide for preventing the covered group of bristles 112 from protruding from the aperture 204 arrange in the wall 206 of the slideable cap 104 when the slideable cap 104 is displaced from the use position 108 to the stowed position 106. For example, because the apertures 204 and 208 are unaligned the aperture 204 is effectively closed off by an inside of the wall 210 of the rotatable sleeve 212. With the aperture 204 being closed the group of bristles 112 in contact with an inside of the wall 206 of the slideable cap 104 slide past the aperture 204 as the slideable cap 104 is displaced past the group of bristles 112. In this way, the unaligned apertures 204 and 208 provide for preventing the covered group of bristles 112 from protruding from the aperture 204 arrange in the wall 206 of the slideable cap 104 when the slideable cap 104 is displaced from the use position 108 to the stowed position 106.

While the slideable cap 104 and the rotatable sleeve 212 are each shown having one aperture 204 and 208, respectively, the slideable cap 104 and the rotatable sleeve 212 may comprise a plurality of apertures. For example, the slideable cap 104 may comprise a plurality of apertures arranged substantially throughout the entire surface area of the wall 206 of the slideable cap 104. For example, the slideable cap 104 may comprise a plurality of apertures arranged in a floral pattern. Further, the apertures may have varying sizes and or shapes. Similarly, and for example, the rotatable sleeve 212 may comprise a plurality of apertures arranged substantially throughout the entire surface area of the wall 210 of the rotatable sleeve 212.

The plurality of apertures arranged in the walls 210 and 206 of the rotatable sleeve 212 and the slideable cap 104, respectively, may need to be substantially similar patterns, shapes, and/or sizes so that the plurality of apertures may align and/or unaligned when the rotatable sleeve 212 is displaced to and/or from the open position 214 and the closed position 216. For example, the rotatable sleeve 212 may comprise a plurality of apertures arranged in a substantially similar floral pattern in the wall 210 as a floral pattern arranged in the wall 206 of the slideable cap 104. When the rotatable sleeve 212 is in the open position 214, the floral pattern arranged in the wall 210 of the rotatable sleeve 212 aligns with the floral pattern in the wall 206 of the slideable cap 104. Further, when the rotatable sleeve 212 is in the closed position 216, the apertures arranged in the floral pattern in the wall 210 of the rotatable sleeve 212 unalign with the apertures arranged in the floral pattern in the wall 206 of the slideable cap 104.

The brush system 102 may include the removeable cap 134. The removeable cap 134may encapsulate the covered group of bristles 112 when the slideable cap 104 is in the use position 108. As FIG. 2 illustrates, the removeable cap 134 may removable couple with an end 218 of the rotatable sleeve 212. While FIG. 2 illustrates the removeable cap 134 may be removeably coupled with the end 218 of the rotatable sleeve 212, the removeable cap 134may removeably receive the end 136 of the slideable cap 104. For example, the end 136 of the slideable cap 104 may protrude out past the end 218 of the rotatable sleeve 212, and the removeable cap 134 may removeably couple with the end 136 of the slideable cap 104.

Further, while FIG. 2 illustrates the rotatable sleeve 212 and the slideable cap 104 having a substantially similar length, the rotatable sleeve 212 may have a length less than a length of the slideable cap 104. For example, the rotatable sleeve 212 may comprise a length of at least about ¼ the length of the slideable cap 104, at least about ½ the length of the slideable cap 104, or at least about ¾ the length of the slideable cap 104, etc. With the rotatable sleeve 212 being shorter than the slideable cap 104, a user may grip the slideable cap 104 and the rotatable sleeve 212 and subsequently rotate the rotatable sleeve 212 relative to the slideable cap 104.

The brush system 102 may comprise an alignment feature 220 arranged in a wall 222 of the handle 110. The alignment feature 220 may be a groove, a ridge, a rail, a planar surface or the like, arranged in the wall 222 that guides the slideable cap 104 and the rotatable sleeve 212 on the handle 110. For example, the alignment feature 220 may be a plurality of planar surfaces arranged in the wall 222 and around the end 114 of the handle 110. For example, the alignment feature 220 may be a plurality of planar surfaces arranged in a ferrule of the brush system 102. The alignment feature 220 may cooperate with alignment feature 224 arranged in the wall 206 of the slideable cap 104. The alignment features 220 and 224 may cooperate to provide for guiding the slideable cap 104 and/or the rotatable sleeve 212 to and/or from the stowed position 106 and the use position 108. For example, the cooperating alignment features 220 and 224 may prevent the slideable cap 104 from rotating about the handle 110. The slideable cap 104 may comprise another alignment feature 226 arranged in the wall 206. For example, the slideable cap 104 may comprise a rib, a groove, a ridge, a rail, a planar surface or the like, arranged in the wall 206 that guides the rotatable sleeve 212. The other alignment feature 226 may cooperate with an alignment feature 228 arranged in the wall 210 of the rotatable sleeve 212. For example, the rotatable sleeve 212 may comprise a cooperating rib, groove, ridge, rail, planar surface or the like, arranged in the wall 210 that guides the rotatable sleeve 212 around the slideable cap 104. The cooperating alignment features 226 and 228 may provided for guiding the rotatable sleeve 212 to and/or from the open position 214 and the closed position 216. For example, the cooperating alignment features 226 and 228 may prevent the rotatable sleeve 212 from sliding up and/or down along the length of the slideable cap 104. The slideable cap 104 and the rotatable sleeve 212 may comprise cooperating stop features 230(A) and 230(B) arranged in walls 206 and 210. The cooperating stop features 230(A) and 230(B) may provide for stopping the rotatable sleeve 212, relative to the slideable cap 104, when the rotatable sleeve 212 is rotated to and/or from the open position 214 and the closed position 216. The alignment features 220, 224, 226, 228, 230(A) and 230(B) cooperating to prevent the slideable cap 104 from inadvertently being slideably displaced from the use position 108 to the stowed position 106 when the rotatable sleeve 212 is in the open position 214. Because the alignment features 220, 224, 226, 228, 230(A) and 230(B) may prevent the slideable cap 104 from inadvertently being slideably displaced from the use position 108 to the stowed position 106 when the rotatable sleeve 212 is in the open position 214, this protects the group of bristles 112 from being accidentally damaged. For example, the alignment features 220, 224, 226, 228, 230(A) and 230(B) may require a user to first rotate the rotatable sleeve 212 to the closed position 216, unaligning apertures 204 and 208 to prevent the covered group of bristles 112 from protruding from the aperture 204, and then subsequently displace the slideable cap 104 to the stowed position 106.

Figure 3:
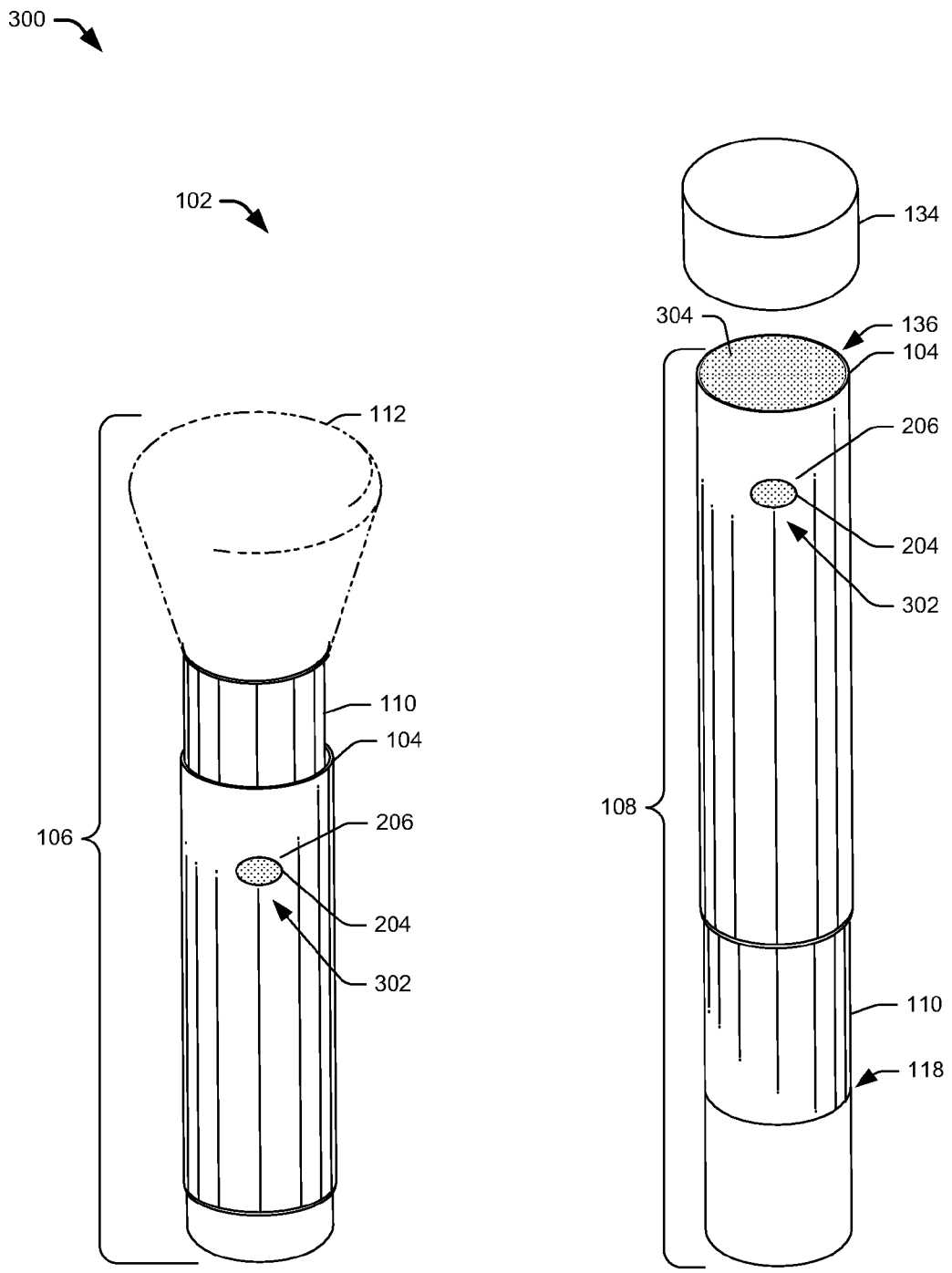
FIG. 3 illustrates an alternative implementation of a slideable cap with a ventilation system.

FIG. 3 illustrates a perspective view 300 of an alternative embodiment of the brush system 201 having a slideable cap 104 with a ventilation system 302. The ventilation system 302 may provide for ventilating the covered group of bristles 112 when the slideable cap 104 is in the use position 108. The ventilation system 302 may comprise the at least one aperture 204 arranged in the wall 206 of the slideable cap 104. The ventilation system 302 may also comprise a breathable liner 304 lining the inside of the wall 206 of the slideable cap 104. For example, the breathable liner 304 may be a breathable fabric lining the inside of the wall 206. The breathable fabric may be formed of a natural material (e.g., cotton, wool, silk, flax, etc.) and/or synthetic material (e.g., polyester, acrylic, polyamide, polyurethane, etc.). The breathable liner 304 may be fixed to the inside wall 206 via an adhesive and/or via one or more fasteners. Further, the breathable liner 304 may be stretched adjacent to the inside of the wall 206 and fastened to the outside of the wall 206 via an adhesive and/or via one or more fasteners. Further, the liner 304 may be attached only behind the aperture 204, but not on all of the inside surface of the slideable cap 104.

The breathable liner 304 may prevent the covered group of bristles 112 from protruding from the aperture 204 arranged in the wall 206 of the slideable cap 104 when the slideable cap 104 is displaced from the use position 108 to the stowed position 106. The breathable liner 304, by virtue of being breathable, may also provide for ventilating the covered group of bristles 112 in cooperation with the at least one aperture 204 arranged in the wall 206 of the slideable cap 104 when the slideable cap 104 is in the use position 108.

As discussed above, with respect to FIG. 2, while the slideable cap 104 is shown having one aperture 204, the slideable cap 104 may comprise a plurality of apertures. For example, the slideable cap 104 may comprise a plurality of apertures arranged substantially throughout the entire surface area of the wall 206 of the slideable cap 104. The breathable liner 304 lining the inside of the wall 206 of the slideable cap 104 may cover substantially all of the apertures arranged substantially throughout the entire surface area of the wall 206 of the slideable cap 104. In this way, the breathable liner 304 may prevent the covered group of bristles 112 from protruding from the plurality apertures when the slideable cap 104 is displaced from the use position 108 to the stowed position 106.

The brush system 102 illustrated in FIG. 3 may include the removeable cap 134. As FIG. 3 illustrates, the removeable cap 134 may removeably couple with an end 136 of the slideable cap 104. The removeable cap 134 may encapsulate the covered group of bristles 112 when the slideable cap 104 is in the use position 108.

Figure 4:
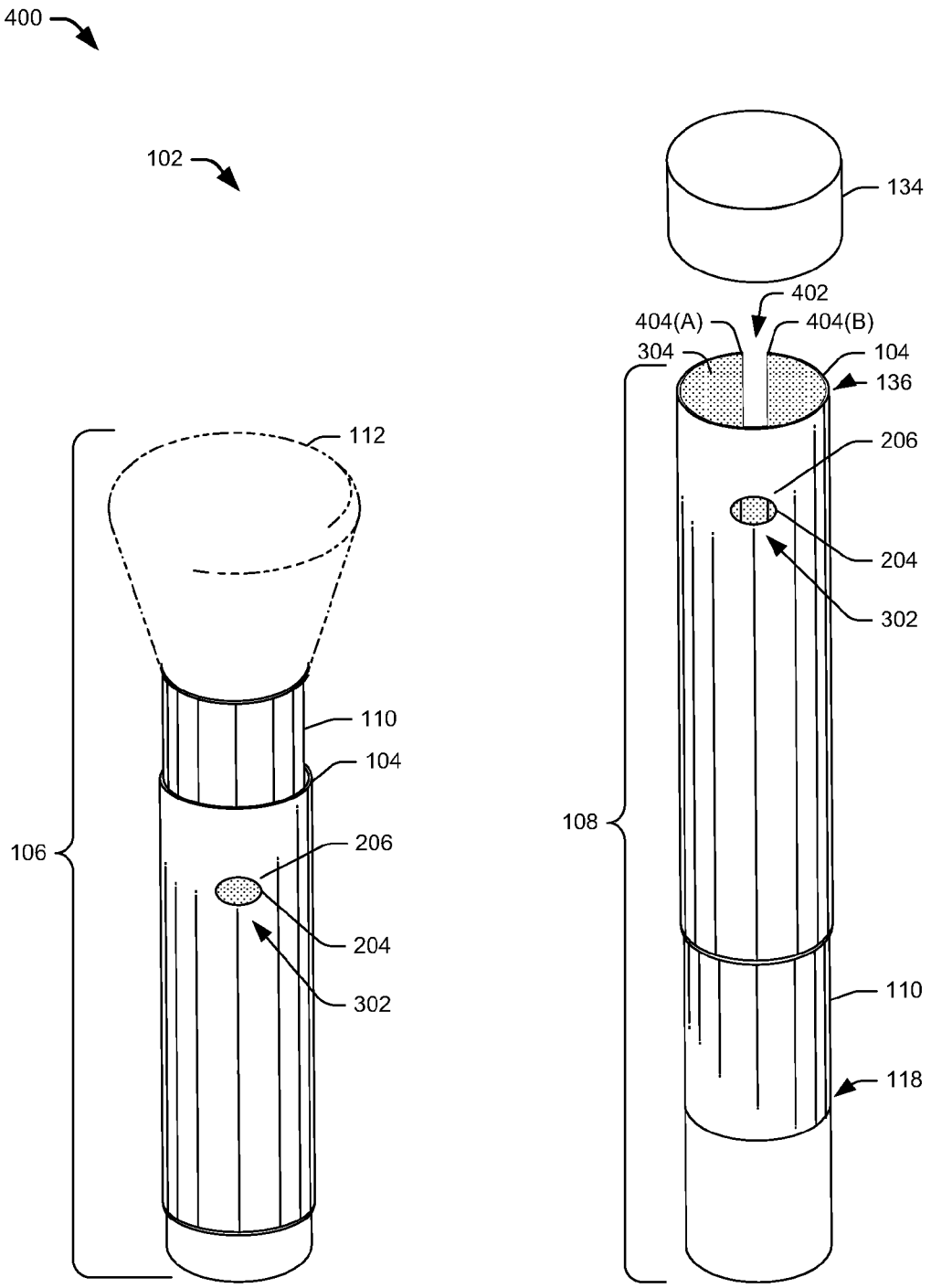
FIG. 4 illustrates another alternative implementation of a slideable cap with a ventilation system.

FIG. 4 illustrates a perspective view 400 of another alternative implementation of the brush system 102 having a slideable cap 104 with the ventilation system 302. As discussed above, with respect to FIG. 3, the ventilation system 302 may provide for ventilating the covered group of bristles 112 when the slideable cap 104 is in the use position 108. The ventilation system 302 may comprise the at least one aperture 204 arranged in the wall 206 of the slideable cap 104 and a breathable liner 304 lining the inside of the wall 206 of the slideable cap 104.

The slideable cap 104 may comprise a slit 402 cut vertically in the wall 206 along substantially the entire length of the slideable cap 104. The slit 402 may provide for wrapping the slideable cap 104 around a handle 110 of a brush system 102. For example, the a handle 110 may comprise an end cap (not shown) fixed to the end of the handle 110 opposite to the group of bristles 112 having an outer diameter that is substantially the same as an outer diameter of the slideable cap 104. In this embodiment, the slit 402 provides for wrapping the slideable cap 104 around the handle 110 above the end cap. For example, the slit 402 be made wider than the outer diameter of the handle 110 by forceably opening the slit 402 and mating the slideable cap 104 to the handle 110.

The breathable liner 304 lining the inside of the wall 206 of the slideable cap 104 may be fixed to the slit 402. For example, the breathable liner 304 may be fixed to first and second edges 404(A) and 404(B) of the slit 402. The edges 404(A) and 404(B) may comprise teeth, clamps, and/or folds to fasten the breathable liner 304 to the edges 404(A) and 404(B) of the slit 402.

The slideable cap 104 illustrated in FIG. 4 may be coupled to the handle 110 during a time of manufacture of the brush system 102. Alternatively the slideable cap 104 may be coupled to the handle 110 after a time of manufacture of the brush system 102. For example, a user may couple the slideable cap 104 to the handle 110 by sliding the slideable cap 104 up from the end 118 of the handle 110 opposite to the group of bristles 112. Alternatively, a user may couple the slideable cap 104 to the handle 110 by wrapping the slideable cap 104 around the handle 110 via the slit 402.

As discussed above with respect to FIG. 1, the slideable cap 104 may be formed of metal, plastic (e.g., polypropylene (PP), acrylonitrile butadiene styrene (ABS), Polyoxymethylene (POM)), glass, wood, any other suitable material, and/or combination of suitable materials for forming a brush system having a slideable cap 104 that selectively covers the group of bristles 112. Here in this embodiment, the slideable cap 104 may be formed of a flexible plastic (e.g., polypropylene (PP), acrylonitrile butadiene styrene (ABS)).

Figure 5:
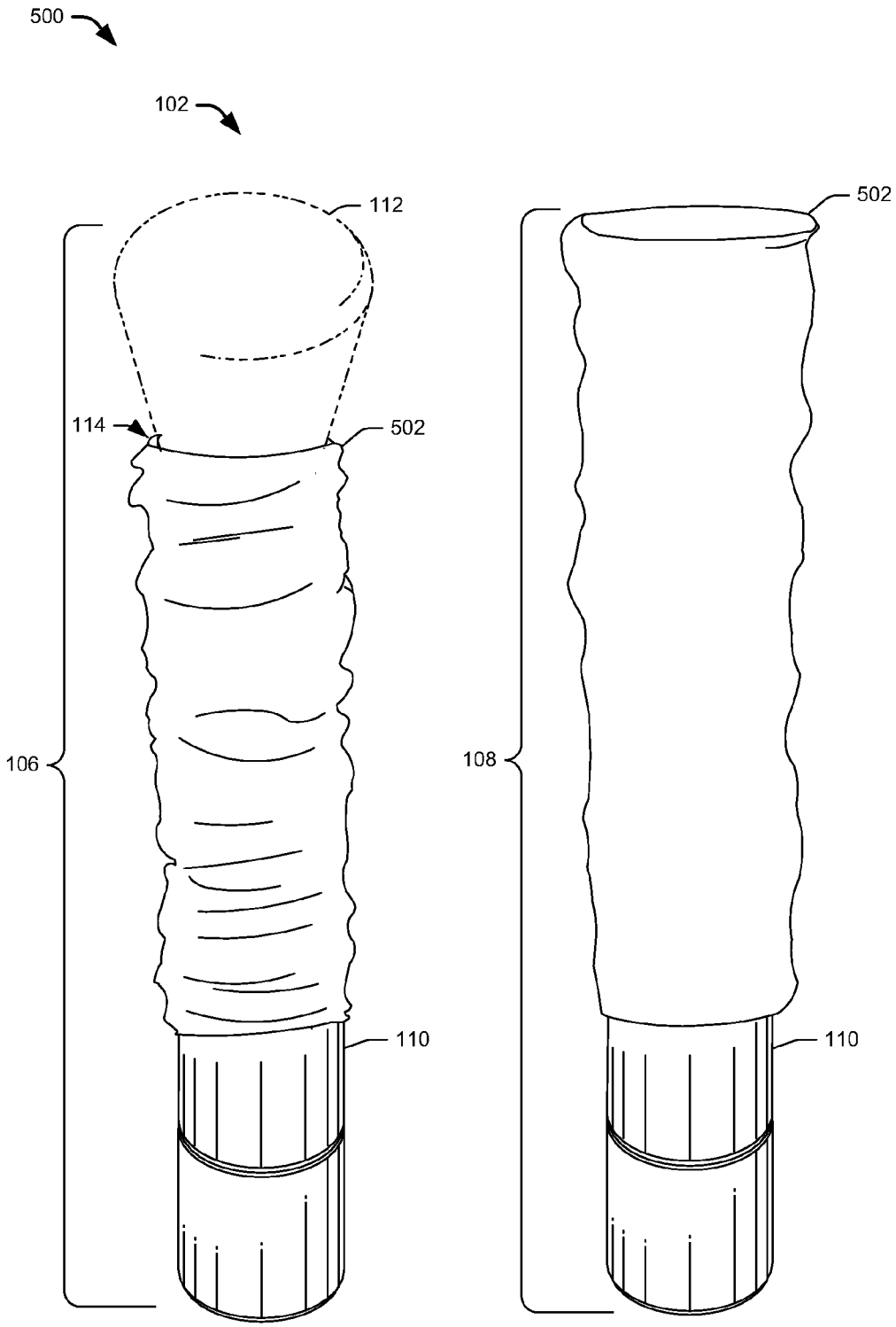
FIG. 5 illustrates another alternative implementation of a slideable cap.

FIG. 5 illustrates a perspective view 500 of an alternative implementation of the brush system 102 having of a slideable cap 502. The slideable cap 502 may be formed of a fabric. The fabric forming the slideable cap 502 may be a breathable fabric. The fabric may be formed of a natural material (e.g., cotton, wool, silk, flax, etc.) and/or synthetic material (e.g., polyester, acrylic, polyamide, polyurethane, etc.).

The fabric forming the slideable cap 502 may be coupled to the handle 110 to slide to and/or from the stowed position 106 and the use position 108. For example, the fabric forming the slideable cap 502 may be slideably pulled up and/or down between the stowed position 106 and the use position 108. The slideable cap 502 may cover the group of bristles 112 fixed in an end 114 of the handle 110 when the slideable cap 502 is in the use position 108. In the stowed position 106, the slideable cap 502 may cover a portion of the handle 110. Further, and in the stowed position, the slideable cap 502 may provide a comfort grip to a user. For example, the fabric forming the slideable cap 502 may comprise a softer, suppler, grip than material forming the handle 110.

Figure 6:
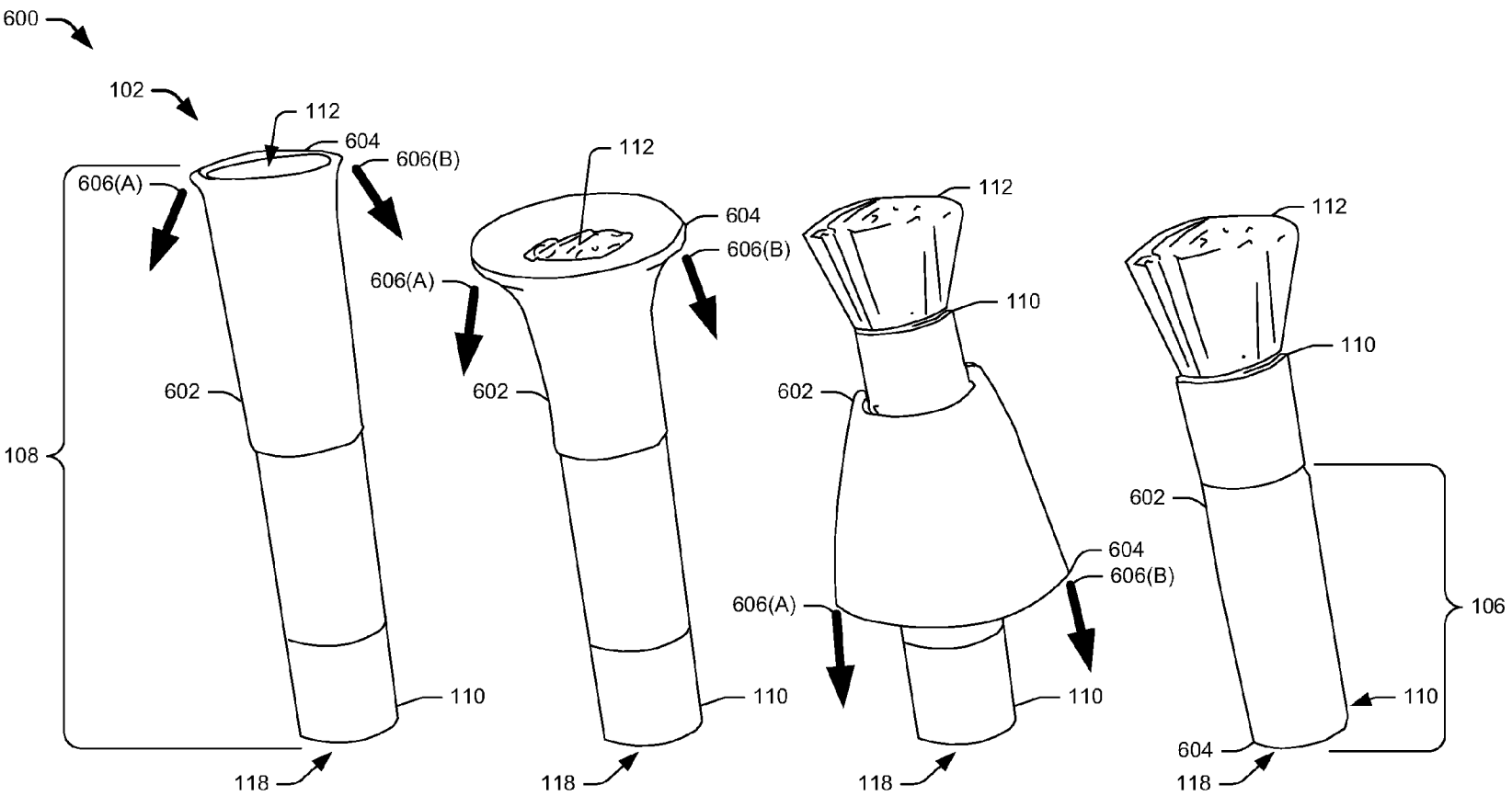
FIG. 6 depicts an illustrative brush system having a peelable cap.

FIG. 6 illustrates a perspective view 600 of an implementation of the brush system 102 having a peelable cap 602. The peelable cap 602 may be formed of a flexible material. The flexible material forming the peelable cap 602 may be a polymer (e.g., natural rubber, synthetic rubber, silicone, polychloroprene, or the like). For example, the peelable cap 602 may be formed of a material suitably flexible to be deformed back over itself.

The flexible material forming the peelable cap 602 may be coupled to the handle 110 to peel to and/or from the stowed position 106 and the use position 108. The peelable cap 602 may cover the group of bristles 112 when the peelable cap 602 is in the use position 108 and cover the handle 110 when in the stowed position 106. For example, a user may deform a lip 604 of the peelable cap 602 in the direction of arrows 606(A) and 606(B), back over the peelable cap 602, and down to the other end 118 of the handle 110 opposite to the group of bristles 112. Further, a user may deform the lip 604 back over the peelable cap 602, in the opposite direction of the arrows 606(A) and 606(B), back up to the end 114 of the handle 110 adjacent to the group of bristles 112.

Conclusion

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, in various embodiments, any of the structural features and/or methodological acts described herein may be rearranged, modified, or omitted entirely. For example, the shape, size, and configuration of the displaceable cap, handle, and group of bristles may be varied.

What is claimed is:

1. A cosmetic brush for applying a product to a body comprising:

a handle having a group of bristles fixed in a top end of the handle opposite a bottom end of the handle; and a cap slideably coupled to the handle and configured to be slideably displaced, while remaining coupled to the handle, from a stowed position exposing the group of bristles to a use position covering the group of bristles, the cap comprising;

a ventilation system to ventilate the covered group of bristles when the cap is in the use position, the ventilation system comprising at least one aperture arranged in a wall of the cap and at least one other aperture arranged in a wall of a sleeve rotatably coupled to the cap, the sleeve configured to rotate between an open position and a closed position; wherein when the sleeve is in the open position, the at least one aperture arranged in the wall of the cap is aligned with the at least one other aperture arranged in the wall of the sleeve to ventilate the covered group of bristles; and when the sleeve is in the closed position, the at least one aperture arranged in the wall of the cap is unaligned with the at least one other aperture arranged in the wall of the sleeve to prevent the covered group of bristles from protruding from the least one aperture arranged in the wall of the cap when the cap slides between the use position and the stowed position.

2. The cosmetic brush according to claim 1, further comprising a locking mechanism configured to prevent the cap from inadvertently being slideably displaced from the use position to the stowed position when the sleeve is in the open position.

3. The cosmetic brush according to claim 1, wherein the handle and cap have substantially elongated cylindrical shapes.

4. The cosmetic brush according to claim 1, further comprising a ballast fixed in the bottom end of the handle opposite the group of bristles, the ballast located so as to position a centroid of the handle closer to the bottom end of the handle than to the top end of the handle, and wherein the handle comprises an end cap fixed to the bottom end of the handle, the end cap receiving at least a portion of the handle and encapsulating the ballast.

5. The cosmetic brush according to claim 4, wherein the end cap has an outer diameter that is substantially the same as an outer diameter of the cap.

6. The cosmetic brush according to claim 1, wherein the group of bristles has a substantially domed shape.

7. The cosmetic brush according to claim 1, wherein the group of bristles comprises animal hair and/or synthetic material.

8. A brush comprising:

a handle having an application surface fixed in a top end of the handle opposite a bottom end of the handle;

a cap slideably coupled to the handle to slide between a stowed position and a use position, the slideable cap configured, when in the use position, to cover the application surface and provide for ventilating the application surface via at least one aperture arrange in a wall of the cap; and a breathable liner lining an inside of the wall of the cap, the breathable liner configured to prevent the application surface from protruding from the aperture arranged in the wall of the cap when the cap is slideably displaced from the use position to the stowed position, and to provide for ventilating the application surface in cooperation with the at least one aperture arranged in the wall of the cap when the cap is in the use position.

9. The brush according to claim 8, comprising a sleeve rotatably coupled to the cap to rotate between an open position and a closed position, the sleeve having at least one aperture arranged in a wall of the sleeve; wherein when the sleeve is in the open position, the aperture arranged in the wall of the cap is aligned with the aperture arranged in the wall of the sleeve to ventilate the application surface; and when the sleeve is in the closed position, the aperture arranged in the wall of the cap is unaligned with the aperture arranged in the wall of the sleeve to prevent the application surface from protruding from the aperture arranged in the wall of the cap when the cap is slid between the use position and the stowed position.

10. The brush according to claim 9, further comprising an alignment feature arranged in a wall of the handle and cooperating alignment features arranged in walls of the cap and the sleeve, the alignment features cooperating to prevent the cap from inadvertently being slideably displaced from the use position to the stowed position when the sleeve is in the open position.

11. The brush according to claim 8, wherein the breathable liner comprises a fabric.

12. The cosmetic according to claim 8, wherein the application surface comprises a brush, a sponge, a flocking, or a combination thereof.

13. The brush according to claim 8, further comprising a ballast fixed at or near the bottom end of the handle to position a centroid of the brush closer to the bottom end of the handle than to the top end of the handle.

14. An applicator for applying a product comprising:

a first tube slideably receiving at least a portion of a second tube;

the second tube comprising an application surface fixed in a first end of the second tube and a ballast fixed at or near a second end of the second tube opposite to the application surface, wherein the application surface is configured to apply the product and the ballast is configured to position a centroid of the applicator closer to the second end of the second tube than to the first end of the second tube; and the first tube configured to be slideably displaced between a stowed position and a use position that covers the application surface, the first tube comprising;

a ventilation system to ventilate the application surface when the first tube is in the use position, the ventilation system comprising at least one aperture arranged in a wall of the first tube and at least one other aperture arranged in a wall of a sleeve rotatably coupled to the first tube, the sleeve configured to rotate between an open position and a closed position; wherein when the sleeve is in the open position, the at least one aperture arranged in the wall of the first tube is aligned with the at least one other aperture arranged in the wall of the sleeve to ventilate the application surface; and when the sleeve is in the closed position, the at least one aperture arranged in the wall of the first tube is unaligned with the at least one other aperture arranged in the wall of the sleeve to prevent the application surface from protruding from the least one aperture arranged in the wall of the first tube when the first tube slides between the use position and the stowed position.

15. The applicator according to claim 14, further comprising an end cap fixed to the second end of the second tube, the end cap receiving at least a portion of the second tube and encapsulating the ballast and, wherein an outer diameter of the end cap is substantially the same as an outer diameter of the first tube.

16. The applicator according to claim 14, further comprising a removeable cap to removably receive an end of the first tube when the first tube is in the use position and thereby encapsulate the application surface.

17. The applicator according to claim 14, wherein the application surface comprises a brush, a sponge, a flocking, or a combination thereof.

* * * * *